United States Patent [19]

Meindl

[11] Patent Number: 4,686,906

[45] Date of Patent: Aug. 18, 1987

[54] CLAMPING DEVICE WITH TEST SPRING DEFORMATION MEASUREMENT

[75] Inventor: Bernd Meindl, Wolfurt, Austria

[73] Assignee: Konrad Doppelmayr & Sohn Maschinefabrik Gesellschaft m.b.H & Co. KG., Austria

[21] Appl. No.: 740,070

[22] PCT Filed: Sep. 19, 1984

[86] PCT No.: PCT/AT84/00031

§ 371 Date: May 14, 1985

§ 102(e) Date: May 14, 1985

[87] PCT Pub. No.: WO85/01257

PCT Pub. Date: Mar. 28, 1985

[30] Foreign Application Priority Data

Sep. 20, 1983 [AT] Austria ..... 3354/83

[51] Int. Cl.[4] ..... B61B 12/06; B61B 12/12

[52] U.S. Cl. ..... 104/209; 104/204

[58] Field of Search ..... 104/202, 204, 209, 216; 188/1.11; 267/151; 73/161

[56] References Cited

U.S. PATENT DOCUMENTS

| | | | |
|---|---|---|---|
| 3,394,661 | 7/1968 | Muller | 104/202 |
| 3,416,462 | 12/1968 | Pomagalski | 104/202 |
| 3,610,164 | 10/1971 | Feuz | 104/204 |
| 3,714,904 | 2/1973 | Bruggemann et al. | 104/202 |
| 3,871,304 | 3/1975 | Dettoni | 104/202 X |

FOREIGN PATENT DOCUMENTS

| | | |
|---|---|---|
| 1933752 | 1/1970 | Fed. Rep. of Germany . |
| 1371008 | 7/1964 | France . |
| 1537191 | 8/1968 | France . |
| 384614 | 2/1965 | Switzerland . |

*Primary Examiner*—Robert B. Reeves
*Assistant Examiner*—Scott H. Werny
*Attorney, Agent, or Firm*—Pahl, Lorusso & Loud

[57] ABSTRACT

Device for continuously controlling the clamping force in monocable ropeways, comprising a test spring which acts against the pressure spring and which is arranged with the latter-mentioned in the pressure mechanism. A signal and/or stop device is responsive to a deformation of the test spring when a predetermined threshold magnitude of deformation has been exceeded.

11 Claims, 5 Drawing Figures

CLAMPING DEVICE WITH TEST SPRING DEFORMATION MEASUREMENT

The invention relates to an operationally releasable clamping device, in particular for monocable ropeways, comprising at least one clamp embracing the cable by means of two jaws, at least one jaw being forcible against the cable by at least one pressure spring and releasable therefrom by a preferably pivotal lever running up on a stationary rail, further comprising at least one test spring counteracting to the pressure spring, and comprising a device measuring the deformation of the test spring when the jaw is clamped to the cable and actuating a signal and/or stop device, when a predetermined value is exceeded.

In such a mechanism the deformation of the test spring is a measure of the force of the pressure spring causing the clamping effect. This force may decrease in the course of time because of aging of the pressure spring or rupture of single elements thereof, as well as because of wear of the movable connections between the pressure spring and the clamping jaw.

In a known device of the kind described, a stationary rail is supported by a spring which is compressed by the force of a roller of the releasing mechanism which runs up on the rail. If this force falls below a predetermined value the test spring will no longer or only insufficiently be compressed; this prevents the further movement of this hanging unit. A disadvantage of this device is that it is sensitive to pivoting movements of the hanging unit such that dynamic influences may cause switching errors. Furthermore, the force of the pressure spring is measured in the released condition, whereas the force, with the hanging unit being in the clamped condition, is decisive for the safety of clamping.

The object of the invention is to provide a clamping device with a test mechanism for the clamping force which tests the clamping force of the jaws in the clamped condition, this testing not being influenced by movements of the hanging unit and being independent of its speed. According to the invention, this is achieved by arranging the test spring in the pressure mechanism.

Thus, the test elements are arranged near the clamping jaws, and static and dynamic transmission faults are substantially eliminated.

The invention will now be described in detail with reference to the figures. Protection should, however, not be restricted to this possible embodiment of the inventive idea, the reference numbers in particular have illustrative character.

Figure 1:
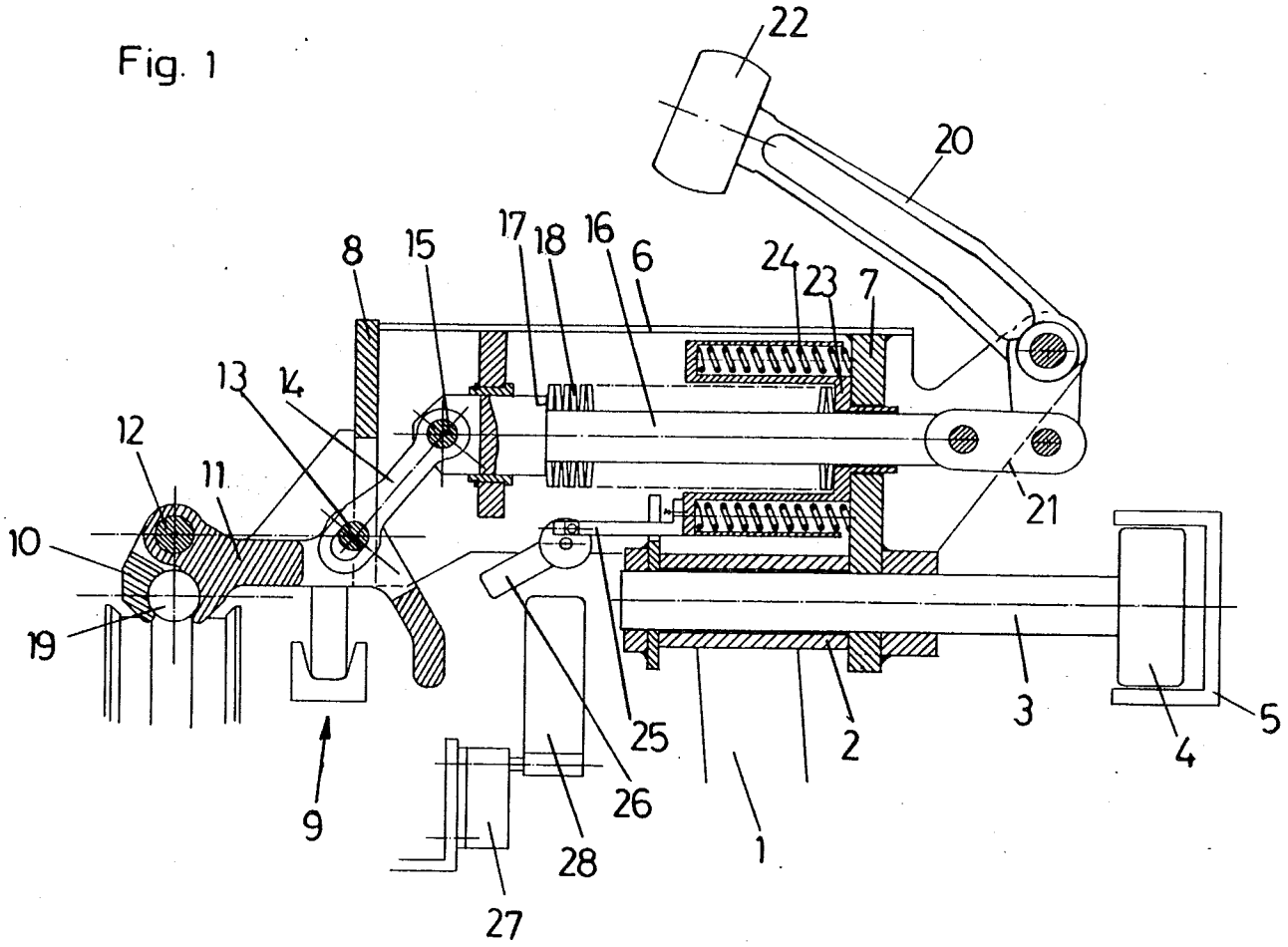
Figure 2:
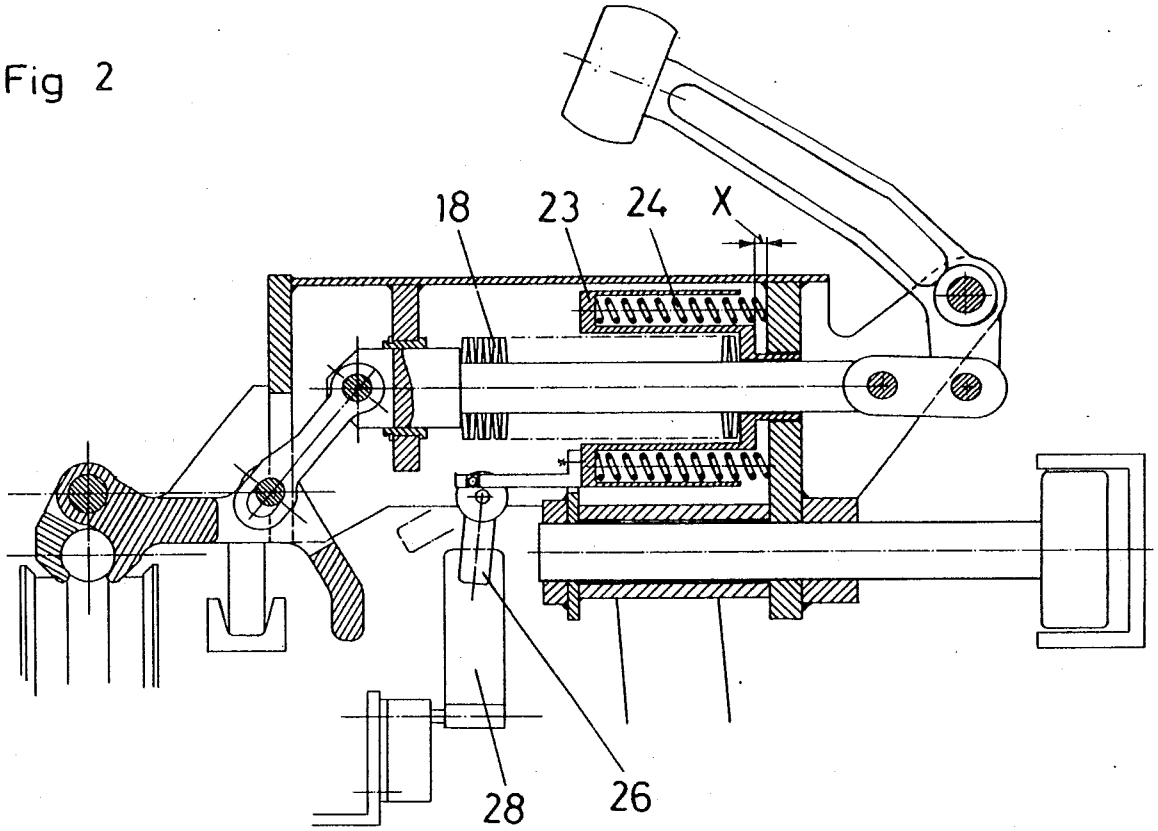
Figure 3:
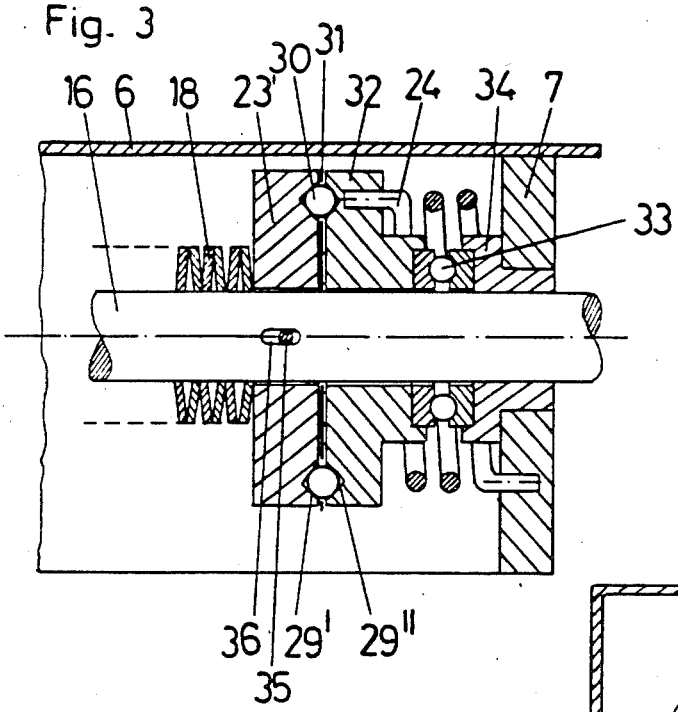
Figure 5:
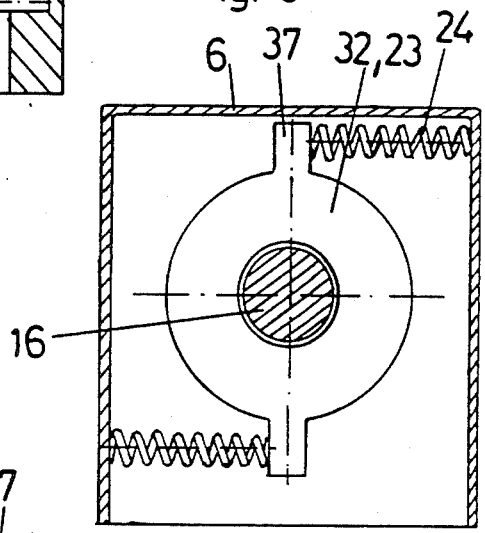
Figure 4:
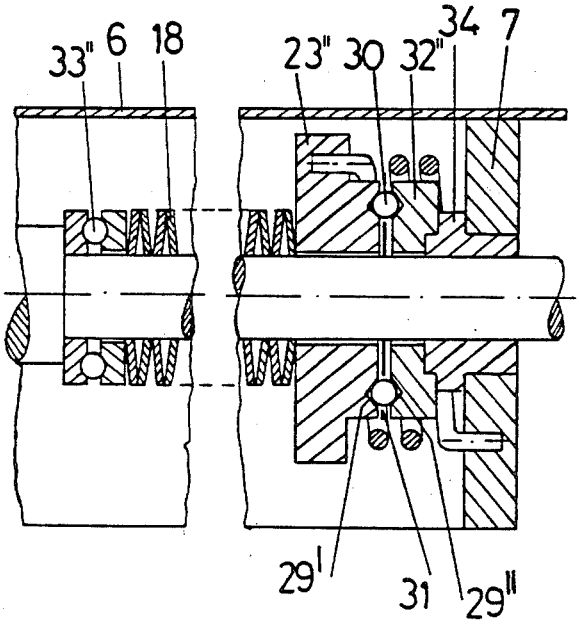

FIG. 1 shows a longitudinal section of a clamping device according to the invention, the parts shown in the position, when the clamping jaw is pressed to the cable, with the force of the pressure spring set being sufficient, FIG. 2 also shows a longitudinal section of the position of the parts, when the clamping force is insufficient, FIGS. 3 and 4, each, show sections of modified forms, FIG. 5 shows a test spring for this modified form.

As shown in FIGS. 1 and 2, the upper end of the hanging unit is provided with a tube member 2 pivotally mounted on an axle 3 in order to permit swinging motions of the hanging unit in the travelling direction. Undesired swinging out transverse to the travelling direction is prevented by a roller 4 mounted at the free end of the axle 3, the roller 4 moving in a guide rail 5 arranged in the station.

The axle 3 is incorporated in a casing consisting of a U-shaped part 6 and two front plates 7 and 8. In 9, a roller of the travelling mechanism and the corresponding travelling rail have been indicated, which supports the hanging unit when released from the cable.

The stationary clamping jaw 10 is fixed on an extension of the casing. The movable clamping jaw 11 is mounted pivotally on a bolt 12. At its end directed to the casing, it is linked to an obliquely arranged pressure member 14 by means of a bolt 13, said pressure member being connected by means of a bolt 15 with a rod 16 which is longitudinally displaceably mounted in the casing. A set of cup springs 18 abuts on a shoulder 17 of said rod which urges the rod 16 in direction to the clamping jaws such that via the pressure member 14 the movable clamping jaw 11 is pressed against the cable 19. The geometry and the spring force are chosen to provide a safety factor of about 3 against slipping, when conditions are most unfavorable.

In order to release the clamping device in the station, rod 16 will be moved against the force of the spring set 18. This is achieved by a pivotally mounted lever 20 connected at its one end to rod 16 by means of a shackle 21 and bearing at its other end a roller 22 which runs up on a stationary rail in the station which is not shown. In order to test in each clamping operation if the spring set 18 exerts the determined force, the set of cup springs does not abut directly on front plate 7 but on a cup-shaped sleeve 23 slideably guided in front plate 7. Sleeve 23 is provided with several axially extending bores for housing coil test springs 24 which rest on front plate 7.

Thus the pressure spring 18 and the test spring 24 rest on a common abutment formed by sleeve 23.

The total force of said test springs 24 is chosen such that it is slightly smaller than the force of spring set 18, when the lower tolerance limit of the spring force has been reached. When, with the hanging unit being clamped to the cable 19, the force of the spring set 18 is smaller than that of the test spring 24 the sleeve 23 is moved in direction towards the cable 19, as shown in FIG. 2. The value "x" of the displacement is a measure for the deficiency of the necessary spring force. In the case that the displacement "x" exceeds a predetermined value, the device will be stopped and/or a signal will be given. For this purpose, a rod-shaped extension 25 is fixed to the sleeve 23 and rotates a switch lever 26. At the exit of the station, when roller 22 has disengaged already from the rail (not shown) there is arranged a stationary switch 27 which is actuated by a pivotal switch member 28. This arrangement is such that switch lever 26 moves past operating element 28 if spring set 18 exerts a sufficient force (FIG. 1). If, however, as shown in FIG. 2, the force of the spring set 18 has decreased to such a value that the test springs 24 shift the sleeve 23 by a certain measure, switch lever 26 is rotated downwards and strikes against the switch member 28. Thus, the apparatus is stopped and/or a signal is emitted.

In the embodiment shown in FIG. 3, measuring of the deformation of the test spring 24 is effected by means of a rotatable element. Abutment 23' has at its side remote from the pressure spring.18 conical recesses 29' in circular arrangement for receiving balls 30 which are held in spaced arrangement by a cage 31 and rest against a thrust plate 32 which also has recesses 29" corresponding to the balls 30. The thrust plate 32 is by means of an axial bearing 33 via a bushing 34 rotatably mounted at front plate 7 of the casing. The ends of a torsion spring 24 engage in corresponding bores of the thrust plate and the front plate 7, respectively. The abutment 23' is prevented from rotation by means of a transversal pin 35 and an oblong hole 36 in the rod 16 but is movable in longitudinal direction. Like in the embodiment according to FIGS. 1 and 2, a coupling member, which is not shown, and a stop are fastened to abutment 23'.

The test spring 24 is prestressed to such an extent as to be unable to rotate the thrust plate 32, when the force of pressure spring 18 is sufficient. If, however, the force of the pressure spring falls below the predetermined value the balls 30 disengage from the recesses 29' or 29" due to the rotation of the thrust plate 32, and the abutment 23 is axially displaced, thus actuating the switch 27 by means of the extension 25, the switch lever 26 and the switch member 28.

As shown in FIG. 4, the pressure spring 18 and the abutment, too, may be rotatably mounted so that means preventing rotation need not be provided. The pressure spring rests at its end remote from the abutment 23" not directly at the rod 16 but by means of an axial bearing 33". Thrust plate 32" rests against front plate 7 and is prevented from rotation in a manner which has not been shown, for example by a pin.

The extension 25 is designed as to permit rotation of the abutment 23" it may for example slideably rest at said abutment. The ends of test spring 24 engage into corresponding bores in abutment 23" and in front plate 7, respectively.

As shown in FIG. 5, the test spring 24 may be a coil spring instead of a torsion spring and abut with its one end on the U-shaped part 6 of the casing and with the other end on an extension 37 of the thrust plate 32" (embodiment according to FIG. 3) or of the abutment 23" (embodiment according to FIG. 4). Preferably a number of test springs are arranged on the circumference.

A number of variants are possible within the scope of the invention. For instance, the displacement of the sleeve could be transmitted to the stationary switch not by mechanical but by electronic, optical, magnetic, etc. means. Furthermore, the test spring could also be designed as a set of cup springs which, however, would increase the required length. Finally, realization of the principle of the invention is not restricted to one clamp with one movable jaw only; it may also be applied to two movable jaws as well as to cable cars with double clamps.

I claim:

1. Clamping device for clamping conveying means to a movable cable, in particular for hanging units of monocable ropeways, said clamping device comprising at least one pair of jaws embracing the rope, at least one of said jaws being forcible against the cable by at least one pressure spring and releasable therefrom by a pivotal lever running up on a stationary rail, means for measuring the deformation of at least one test spring when the jaws are clamped to the cable and for indicating when a predetermined value of deformation is exceeded, at least one test spring being arranged in said clamping device and dimensioned to compress the pressure spring as soon as the spring power of the pressure spring falls below a predetermined value when the jaws are closed.

2. Operationally releasable clamping device for clamping clamping apparatuses to a movable cable, in particular for hanging units of monocable ropeways, comprising at least one clamp embracing the cable by means of two jaws, at least one of said two jaws being forcible against the cable by at least one pressure spring and releasable therefrom by a lever running up on a stationary rail, said pressure spring abutting a movable abutment;

a test spring counteracting the pressure spring;

means for measuring the deformation of the test spring when the jaw is clamped to the cable and for indicating when a predetermined value of the deformation is exceeded, each clamping apparatus including at least one test spring which exerts load on the pressure spring;

the pressure spring and the test spring abutting a common abutment mounted in a casing, at least the part of the abutment on which the pressure spring abuts being displaceable in the direction of the spring path of said pressure spring, the abutment being connected with the device, which when a preset displacement path of the abutment is exceeded, actuates a stationary switch of said means for indicating when a predetermined value of deformation is exceeded.

3. Operationally releasable clamping device for clamping clamping apparatuses to a movable cable, in particular for hanging units of monocable ropeways, comprising at least one clamp embracing the cable by means of two jaws, at least one of said two jaws being forcible against the cable by at least one pressure spring and releasable therefrom by a lever running up on a stationary rail, said pressure spring abutting a movable abutment, a test spring counteracting to the pressure spring, said test spring being supported by said abutment, and means for measuring the deformation of the test spring when the jaw is clamped to the cable and for indicating when a predetermined value of the deformation is exceeded, each clamping apparatus including at least one test spring which exerts a load on the pressure spring.

4. Clamping device according to claim 3, wherein a plurality of test springs arranged parallel to each other are provided.

5. Clamping device according to claim 3, characterized in that the abutment consists of a cup-shaped sleeve, the bottom of which forms the support for the pressure spring and the wall of which is provided with a number of axial bores for receiving the at least one test spring.

6. Clamping device according to claim 3 wherein said lever running up on a stationary rail is a pivotal lever.

7. Clamping device according to claim 3 wherein said test spring is a coil spring.

8. Operationally releasable clamping device for clamping clamping apparatuses to a movable cable, in particular for hanging units of monocable ropeways, comprising at least one clamp embracing the cable by means of two jaws, at least one of said two jaws being forcible against the cable by at least one pressure spring and releasable therefrom by a lever running up on a stationary rail, said pressure spring abutting a movable abutment;

a test spring counteracting the pressure spring, said test spring being supported by said abutment;

means for measuring the deformation of the test spring when the jaw is clamped to the cable and for indicating when a predetermined value of the deformation is exceeded, each clamping apparatus including at least one test spring which exerts a load on the pressure spring;

a thrust plate relatively rotatable with respect to the abutment;

two axial bearings, at least one of said bearings effecting a relative axial displacement of two bearing rings of said two axial bearings, the test spring trying to turn one of the two bearings rings.

9. Clamping device according to claim 8, characterized in that the test spring is a torsion spring.

10. Clamping device according to claim 8, characterized in that the test spring is a spring tangentially acting on one of the two bearing rings.

11. Clamping device according to claim 8, characterized in that at least one of the two bearing rings is provided with a number of recesses into each of which one ball is engageable, the balls abutting on the other bearing ring, preferably also in recesses.

* * * * *